US008670573B2

(12) United States Patent
Theverapperuma et al.

(10) Patent No.: US 8,670,573 B2
(45) Date of Patent: Mar. 11, 2014

(54) LOW LATENCY ULTRA WIDEBAND COMMUNICATIONS HEADSET AND OPERATING METHOD THEREFOR

(75) Inventors: Lalin S. Theverapperuma, St. Paul, MN (US); Darcy Zehnder, Farmington, MN (US); Talal Aly-Youssef, Deephaven, MN (US)

(73) Assignee: Robert Bosch GmbH, Stuttgart (DE)

( * ) Notice: Subject to any disclaimer, the term of this patent is extended or adjusted under 35 U.S.C. 154(b) by 1458 days.

(21) Appl. No.: 12/168,446

(22) Filed: Jul. 7, 2008

(65) Prior Publication Data

US 2010/0002893 A1 Jan. 7, 2010

(51) Int. Cl.
*H04R 27/00* (2006.01)

(52) U.S. Cl.
USPC ..... 381/82; 381/86; 381/370; 455/463; 455/575.2

(58) Field of Classification Search
USPC ..... 381/82, 370, 86; 455/463, 575.2
See application file for complete search history.

(56) References Cited

U.S. PATENT DOCUMENTS

| | | | | |
|---|---|---|---|---|
| 4,352,200 | A | 9/1982 | Oxman | |
| 4,941,187 | A | 7/1990 | Slater | |
| 5,808,661 | A | 9/1998 | Infiesto et al. | |
| 5,844,888 | A * | 12/1998 | Markkula et al. | 370/255 |
| 6,115,357 | A | 9/2000 | Packer et al. | |
| 6,493,316 | B1 * | 12/2002 | Chapman et al. | 370/231 |
| 6,577,606 | B1 | 6/2003 | Lee | |
| 6,693,921 | B1 | 2/2004 | Whitfield | |
| 6,741,659 | B1 | 5/2004 | Chan et al. | |
| 6,757,654 | B1 | 6/2004 | Westerlund et al. | |
| 6,816,592 | B1 | 11/2004 | Kirla | |
| 6,826,154 | B2 * | 11/2004 | Subbiah et al. | 370/236 |
| 6,952,483 | B2 | 10/2005 | Boesen et al. | |
| 6,983,162 | B2 * | 1/2006 | Garani et al. | 455/518 |
| 6,990,319 | B2 * | 1/2006 | Wright et al. | 455/66.1 |
| 7,002,994 | B1 | 2/2006 | Haendel | |
| 7,013,267 | B1 | 3/2006 | Huart et al. | |
| 7,027,774 | B2 | 4/2006 | Kuon | |
| 7,047,187 | B2 | 5/2006 | Cheng et al. | |
| 7,069,208 | B2 | 6/2006 | Wang | |
| 7,151,764 | B1 | 12/2006 | Heinonen et al. | |
| 7,155,654 | B2 | 12/2006 | Chien et al. | |
| 7,181,020 | B1 | 2/2007 | Riley | |
| 7,184,714 | B1 * | 2/2007 | Kutagulla et al. | 455/73 |
| 7,187,647 | B1 | 3/2007 | Gerakoulis et al. | |
| 7,215,790 | B2 | 5/2007 | Boesen et al. | |
| 7,221,717 | B2 | 5/2007 | Yuan et al. | |
| 7,292,823 | B2 | 11/2007 | Kuo | |
| 7,302,227 | B2 * | 11/2007 | Sakoda | 455/41.2 |
| 7,328,012 | B2 * | 2/2008 | Ziarno et al. | 455/431 |

(Continued)

OTHER PUBLICATIONS

Wikipedia Web document about Sliding Window protocol date May 29, 2012.*

(Continued)

*Primary Examiner* — Thinh T Nguyen
(74) *Attorney, Agent, or Firm* — Michael Best & Friedrich LLP

(57) ABSTRACT

A wireless communication system for use in aircraft includes a wireless headset having at least one ear cup with a housing. A first ultra wideband transceiver is disposed in the ear cup housing. A base station includes a second ultra wideband transceiver. The second ultra wideband transceiver wirelessly communicates with the first ultra wideband transceiver.

20 Claims, 9 Drawing Sheets

(56) References Cited

U.S. PATENT DOCUMENTS

| | | | | |
|---|---|---|---|---|
| 7,769,398 | B2 * | 8/2010 | Marston et al. | 455/463 |
| 7,787,913 | B2 * | 8/2010 | Cornell | 455/575.2 |
| 2002/0027886 | A1 * | 3/2002 | Fischer et al. | 370/255 |
| 2002/0080886 | A1 * | 6/2002 | Ptasinski et al. | 375/295 |
| 2005/0232207 | A1 * | 10/2005 | Antoniadis et al. | 370/338 |
| 2005/0260953 | A1 | 11/2005 | Lefler et al. | |
| 2006/0050743 | A1 | 3/2006 | Black et al. | |
| 2006/0056383 | A1 | 3/2006 | Black et al. | |
| 2007/0140187 | A1 * | 6/2007 | Rokusek et al. | 370/338 |
| 2007/0147552 | A1 * | 6/2007 | Olesen et al. | 375/343 |
| 2008/0057858 | A1 * | 3/2008 | Smith | 455/3.05 |

OTHER PUBLICATIONS

Ameti et al. Ultra Wideband Technology for Aircraft Wireless Inter-Communications Systems (AWICS) Design 2003 IEEE Conference on Ultra Wideband Systems and Technologies, Nov. 2003, Reston, VA.

* cited by examiner

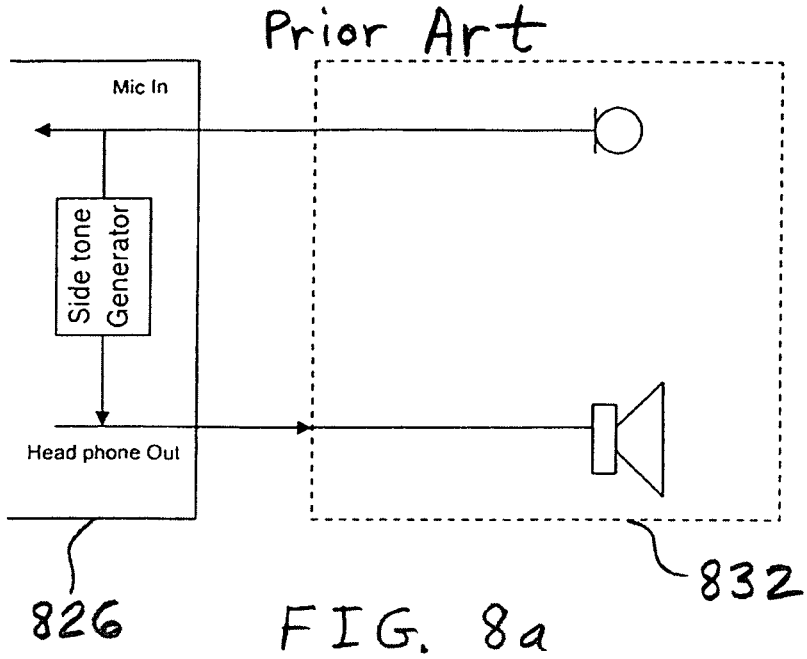
FIG. 8a
FIG. 8b
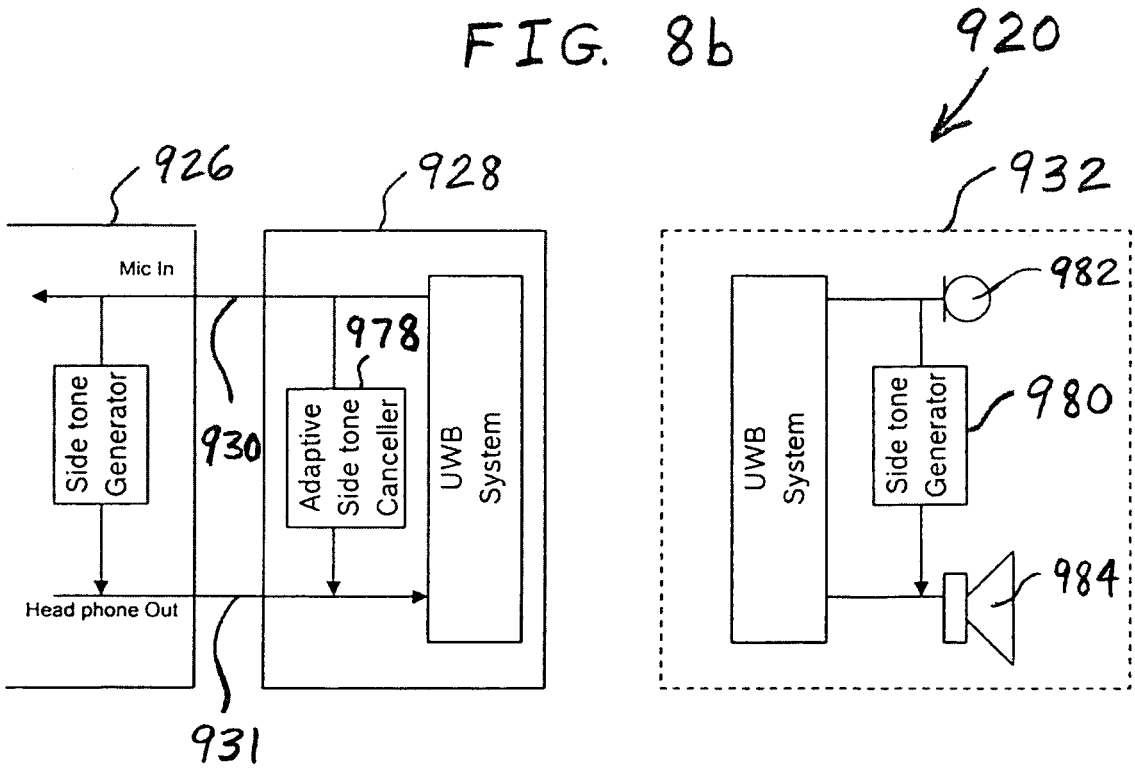

900

LOW LATENCY ULTRA WIDEBAND COMMUNICATIONS HEADSET AND OPERATING METHOD THEREFOR

BACKGROUND

1. Field of the Invention

The present invention relates to audio headsets, and, more particularly, to audio headsets that may be used within an aircraft during flight.

2. Description of the Related Art

Traditionally, wired headsets are used within aircrafts by pilots, passengers, and others inside the plane. Currently, the Federal Aviation Admission does not allow wireless communications that can interfere with avionics during flight. Avionics are susceptible to interference from known short range wireless communications devices, such as cell phones, Bluetooth headsets, and other transmitting Personal Data Assistant devices. This limits the technology options available for headsets that are used inside the aircraft. The transmission systems used in the prior art are based on single carrier-based transmissions. In these systems, the majority of the transmission energy is concentrated around the carrier frequency, such as 2.4 GHz or 900 MH, for example. Typically, the short range wireless transmissions of the prior art use 0.75 to 1.0 watt of power in these narrow frequency bands. These high power, narrow frequency band transmissions can adversely affect the avionics, especially since the avionics are not designed to be immune to such high power transmissions.

Prior art, Bluetooth and related technologies use narrow band carriers, and they use limited frequency-hopping (2.400 GHz-2.480 GHz). FIGS. 1*a* and 1*b* illustrate an exemplary narrow band carrier in the time domain and frequency domain, respectively. Direct sequence spread spectrum (DSSS) and frequency-hopping spread spectrum (FHSS) methods typically occupy larger bandwidths than a simple narrow band transmission. These technologies do improve communication bandwidth and resistance to jamming due to the slightly larger bandwidth However, even with the complex FHSS techniques, these transmissions are susceptible to interference. The bandwidth improvements are in the range of only a few MHz. For example, if an industrial, scientific and medical (ISM) band jammer is effective in the frequency range of 2.40-2.48 GHz, then a Bluetooth device could not function in that environment.

The transmission systems used in the prior art are mostly narrow band carrier-based, and have limited allocated bandwidths to transmit signals. The limited channel capacity results in poor audio quality/intelligibility and unreliability. Channel capacity in a communication channel is given by the Shannon-Hartley theorem, which states that the amount of information delivered via radio is logarithmically proportional to signal strength expressed as signal-to-noise ratio, and directly proportional to the bandwidth. Since the bandwidth in these narrow band channels is limited, the channel capacity is also limited. Due to this limited availability of bandwidth, these systems have limited channel capacity, and these systems fail to implement the necessary error corrections or repeated packet transmissions needed for critical communications.

In the case of poor communication links, the packet errors in these systems will affect the audio quality and intelligibility of the communications. In some situations, the aircraft headset provides mission critical communications between the pilot and the ground tower. Therefore, packet errors in the transmissions and poor intelligibility are not acceptable for this application.

What is needed in the art is a wireless headset that is suitable for use in aircraft and that avoids the above-mentioned problems and disadvantages.

SUMMARY OF THE INVENTION

The present invention provides an integral wireless ultra wide band (UWB) headset that does not interfere with avionics and thus is suitable for use within an aircraft. The UWB headset may include a sliding window packet transmission scheme, a technique for correction and concealment of errors, adaptive packet latency reduction, and a side tone cancellation and regeneration scheme. These algorithms may not be applicable to prior art communication systems, but rather may be applicable to physical layers with high bandwidth channels, such as the UWB communication system of the present invention.

In one embodiment, the invention is directed to the use of ultra wideband communication technology effectuated through a wireless base station/headset combination The headset and base station may both contain a UWB transceiver as well as a digital signal processor, microcontroller, audio CODECs and supporting analog circuitry. A sliding window error packet correction and error concealment algorithm may be implemented to either recover or reconstruct packetized audio information that has been lost or corrupted in transit. Furthermore, transmission latency may be adaptively minimized and a cancellation/regeneration method may be used to filter side tones.

The UWB headset of the present invention uses less transmission power than an unintentional radiator, and this quality enables the headset to be used closer to sensitive instrumentation. The transmitting power of the UWB system is quite low as compared to a cell phone. A cell phone transmits 0.75 to 1.0 watt over a few KHz. UWB systems, in contrast, transmit less than −42 dBm/MHz (0.0000631 milliwatts/MHz). The Federal Communications Commission power spectral density emission limit for UWB emitters operating in the UWB band is −41.3 dBm/MHz. This is the same limit that applies to unintentional emitters, such as computers. Due to this very low power, at any given transmission band the UWB headset does not affect the avionics inside the airplanes. According to the Shannon-Hartley theorem, the amount of information delivered via radio is logarithmically proportional to the signal strength as expressed by the signal-to-noise ratio, and is directly proportional to the bandwidth By using 3 to 5 GHz for transmissions, a larger channel capacity of up to 480 mbps can be achieved. In case of UWB transmissions, the energy may be spread over a large bandwidth, such as the 3 to 5 GHz frequency spectrum. Thus, the bandwidth used in the system is close to 2 GHz and the total transmitted power is 0.12 milliwatt. The UWB technology may be suitable for use in applications that require robustness against intentional and unintentional jammers. UWB technology may provide this robustness by use of the large bandwidth. Use of UWB provides very low transmission power and short pulse widths.

The invention comprises, in one form thereof, a wireless communication system for use in aircraft. A wireless headset includes at least one ear cup having a housing. A first ultra wideband transceiver is disposed in the ear cup housing. A base station includes a second ultra wideband transceiver. The second ultra wideband transceiver wirelessly communicates with the first ultra wideband transceiver.

The invention comprises, in another form thereof, a method of operating a wireless communication system for use in aircraft, including providing a wireless headset within the aircraft. The headset includes a first ultra wideband transceiver. An intercom is provided within the aircraft. A base station is electrically connected to the intercom. The base station includes a second ultra wideband transceiver. Data packets are wirelessly and bi-directionally communicated between the first and second ultra wideband transceivers. The communicating includes transmitting a plurality of frames. Bach of the frames includes a plurality of the data packets. At least one of the data packets in each frame has never before been transmitted. At least one of the data packets in each frame has been earlier transmitted.

The invention comprises, in yet another form thereof, a method of operating a wireless communication system for use in aircraft, including providing a wireless headset within the aircraft. The headset includes a first ultra wideband transceiver, a microphone and a speaker. A first side tone is generated within the headset dependent upon a first microphone signal received from the microphone. The first side tone generated wit the headset is transmitted to the speaker. An intercom is provided within the aircraft. The intercom has a microphone input and a headset output. A base station is electrically connected to the microphone input and the headset output of the intercom. The base station includes a second ultra wideband transceiver. Signals are wirelessly and bi-directionally communicated between the first and second ultra wideband transceivers. A second microphone signal is transmitted from the second ultra wideband transceiver to the microphone input of the intercom. The second microphone signal is a delayed reproduction of the first microphone signal from the headset microphone. A second side tone within the intercom is generated dependent upon the second microphone signal received from the second ultra wideband transceiver. The second side tone generated within the intercom is transmitted to the second ultra wideband transceiver via the headset output of the intercom. A side tone cancellation signal is generated within the base station dependent upon the microphone signal from the second ultra wideband transceiver. The side tone cancellation signal generated within the base station is transmitted to the second ultra wideband transceiver such that the side tone cancellation signal substantially cancels out the second side tone received by the second ultra wideband transceiver.

An advantage of the present invention is that the UWB headset does not affect the avionics due to its use of very low transmission power and short pulses, i.e., carrierless impulse radio.

Another advantage is that, although the invention is described herein as being applied to an audio communication system, the invention can be extended to other real time audio/video systems that use physical layers and/or low data rate communications on high capacity channels, such as inside rooms, automobiles, vessels, boats, or similar enclosed spaces.

Another advantage is that the UWB communications are difficult to intercept due to the low power and short pulses during transmission.

Yet another advantage is that, because an aircraft cabin may have a Faraday cage effect, multipath copies of the transmission may be created. Thus, the UWB system may use rake receiver techniques which recover multipath-generated copies of the original pulse to improve the performance of the receiver. Use of UWB provides a larger channel capacity.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 8*a* is a block diagram of a prior art wired communication system with side tone generation.

FIG. 8*b* is a block diagram of a prior art wired communication system with side tone generation.

Corresponding reference charters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 1A:
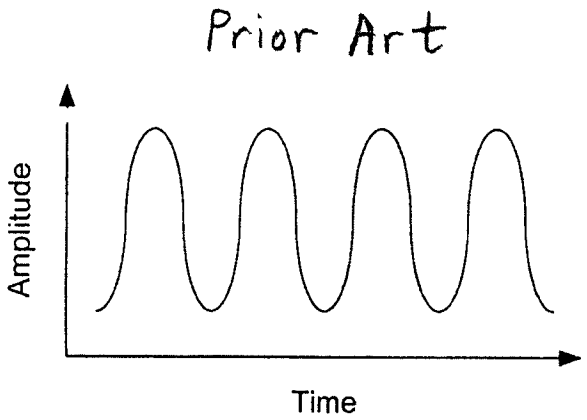
FIG. 1*a* is a time domain plot of an exemplary narrow band carrier used in the prior art.
Figure 1B:
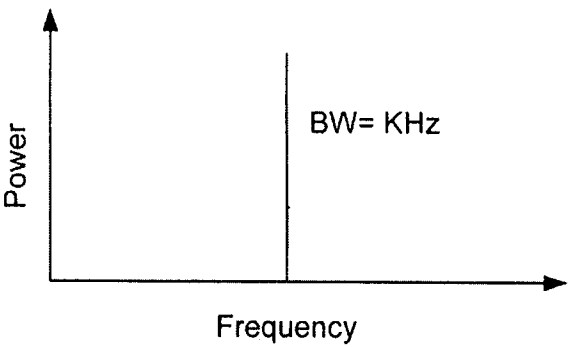
FIG. 1*b* is a frequency domain plot of the narrow band carrier of FIG. 1*a*.
Figure 2A:
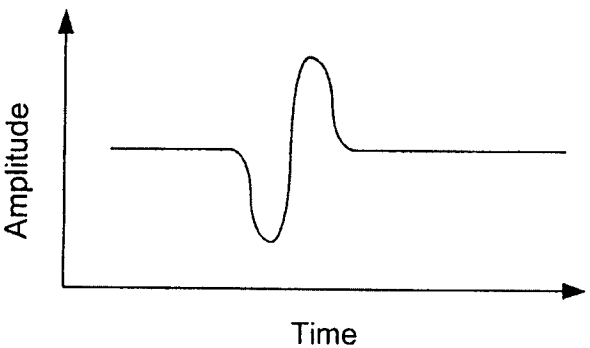
FIG. 2*a* is a time domain plot of an exemplary UWB pulse that may be used in the present invention.
Figure 2B:
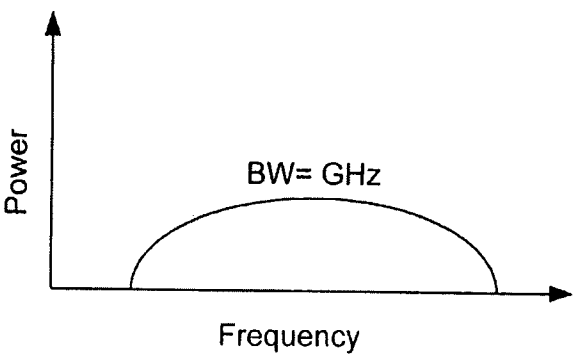
FIG. 2*b* is a frequency domain plot of the UWB pulse of FIG. 2*a*.

Ultra wide band is a communication technique that uses pulses of very short time duration, as plotted in FIG. 2*a*, that result in very large or wideband transmission bandwidths, as plotted in FIG 2*b*. A bandwidth larger than 500 MHz may be considered UWB. This type of transmission differs vastly from carrier-based AM/FM transmissions. UWB transmission is based on pulses, and each pulse in the UWB system may occupy the entire UWB bandwidth. Currently, most UWB devices occupy 3.1-6.1 GHz, and the FCC authorizes the unlicensed use of UWB in 3.1-10.6 GHz.

Figure 3:
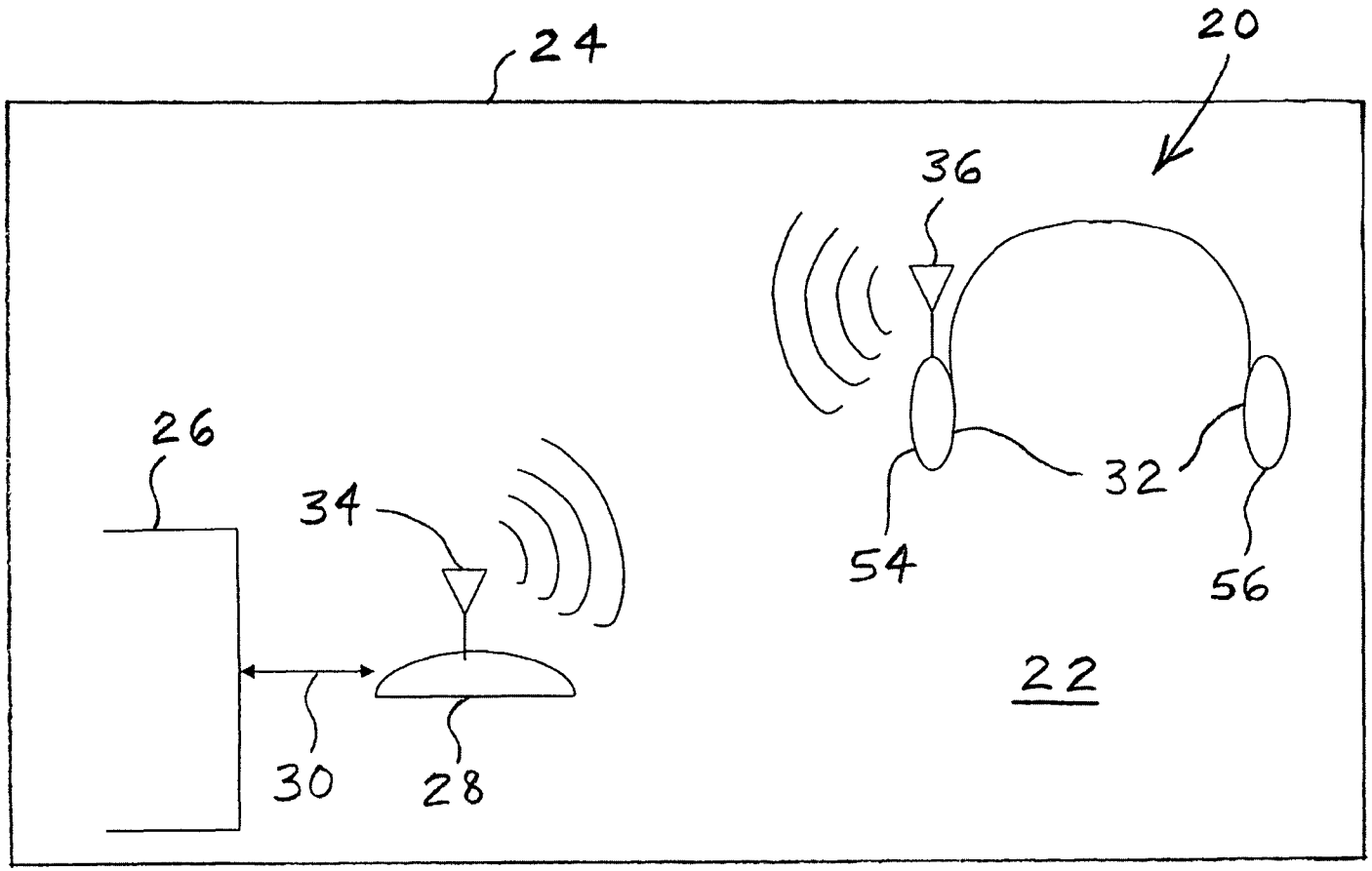
FIG. 3 is a block diagram of one embodiment of a wireless communication system of the present invention in use in a cockpit of an aircraft.

Referring now to FIG. 3, there is shown one embodiment of a wireless communication system 20 of the present invention for use in a cockpit 22 of an aircraft 24. System 20 includes an electronic aviation intercommunication system 26, commonly referred to as an "intercom," in bi-directional communication with a UWB base station 28 via one or more conductors 30. UWB base station 28 is in wireless bi-directional communication with a UWB headset 32 via respective antennae 34, 36.

Figure 4:
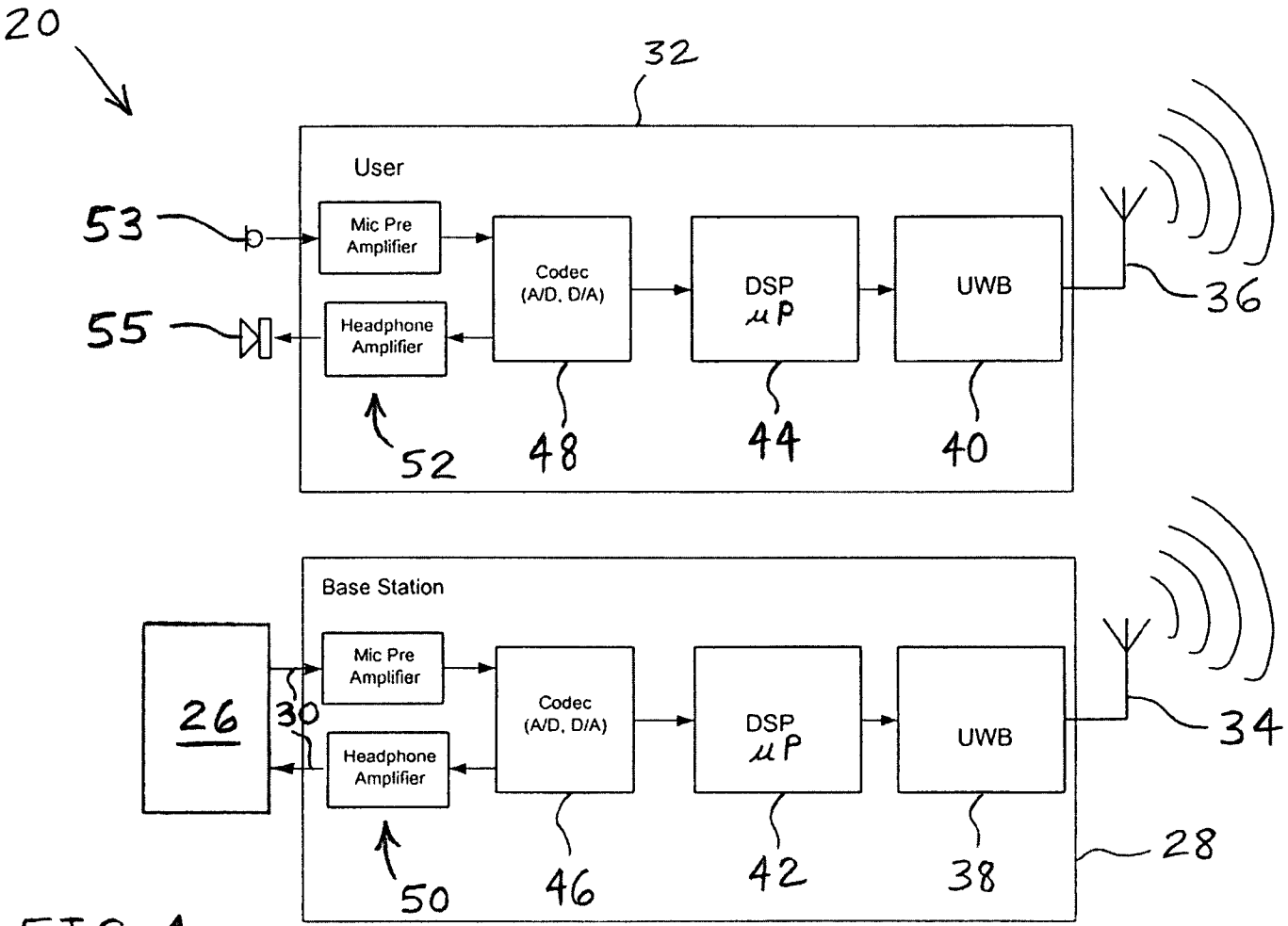
FIG. 4 is a more detailed block diagram of the wireless communication system of FIG. 3.

FIG. 4 provides a more detailed block diagram of system 20. Both base station 28 and headset 32 have respective UWB transmitter/receivers 38, 40, digital signal processor/microprocessors 42, 44, analog-to-digital and digital-to-analog codecs 46, 48, and miscellaneous analog supporting circuits 50, 52. Headset 32 includes a microphone 53 and at least one speaker 55.

In a particular embodiment, UWB transceivers 38, 40 have a bandwidth of 3.1 to 4.8 GHz and the transmission power is below −41.5 dBm/MHz. In one embodiment, UWB transceivers 38, 40 are in the form of 502 and 531 chips supplied by Wisair, Ltd., and DSPs 42, 44 are in the form of C5409 DSPs supplied by Texas Instruments Inc.

Figure 5:
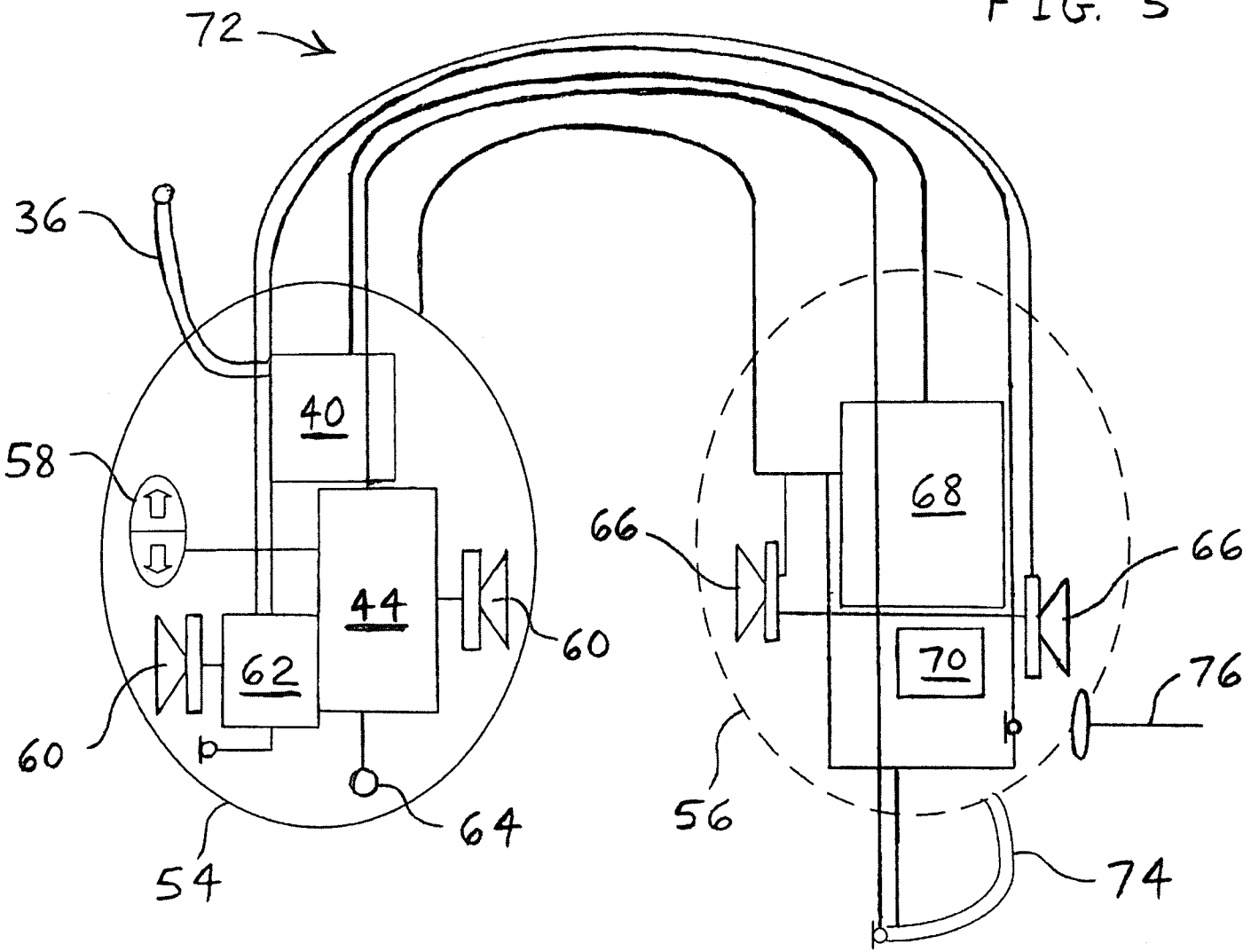
FIG. 5 is another more detailed block diagram of the headset of the wireless communication system of FIG. 3, illustrating one possible distribution of the components between the two ear cups.

UWB transceiver 40 of headset 32 maybe disposed within an ear cup housing 54 (FIG. 5) to which antenna 36 is attached. Antenna 36 is electrically connected to UWB transceiver 40 and projects outwardly from the housing 54. In general, all of the components of headset 32 may be disposed in one or the other of ear cup housings 54, 56. Disposed within housing 54, in addition to transceiver 40 and DSP 44, are a volume controller 58, speakers 60, an active noise reduction circuit 62, and a light-emitting diode 64. Disposed within housing 56 are speakers 66, a battery 68, and a charging circuit 70.

Various electrical conductors 72 may interconnect the components of housings 54, 56. Conductors 72 may be mechanically supported by a semi-rigid band (not shown) that mechanically connects housings 54, 56, as is well known in the art.

Attached to housing 56 may be a boom microphone 74 and a charging cord 76. Cord 76 may be used to charge battery 68, or to provide emergency power in case battery 68 fails.

Figure 6:
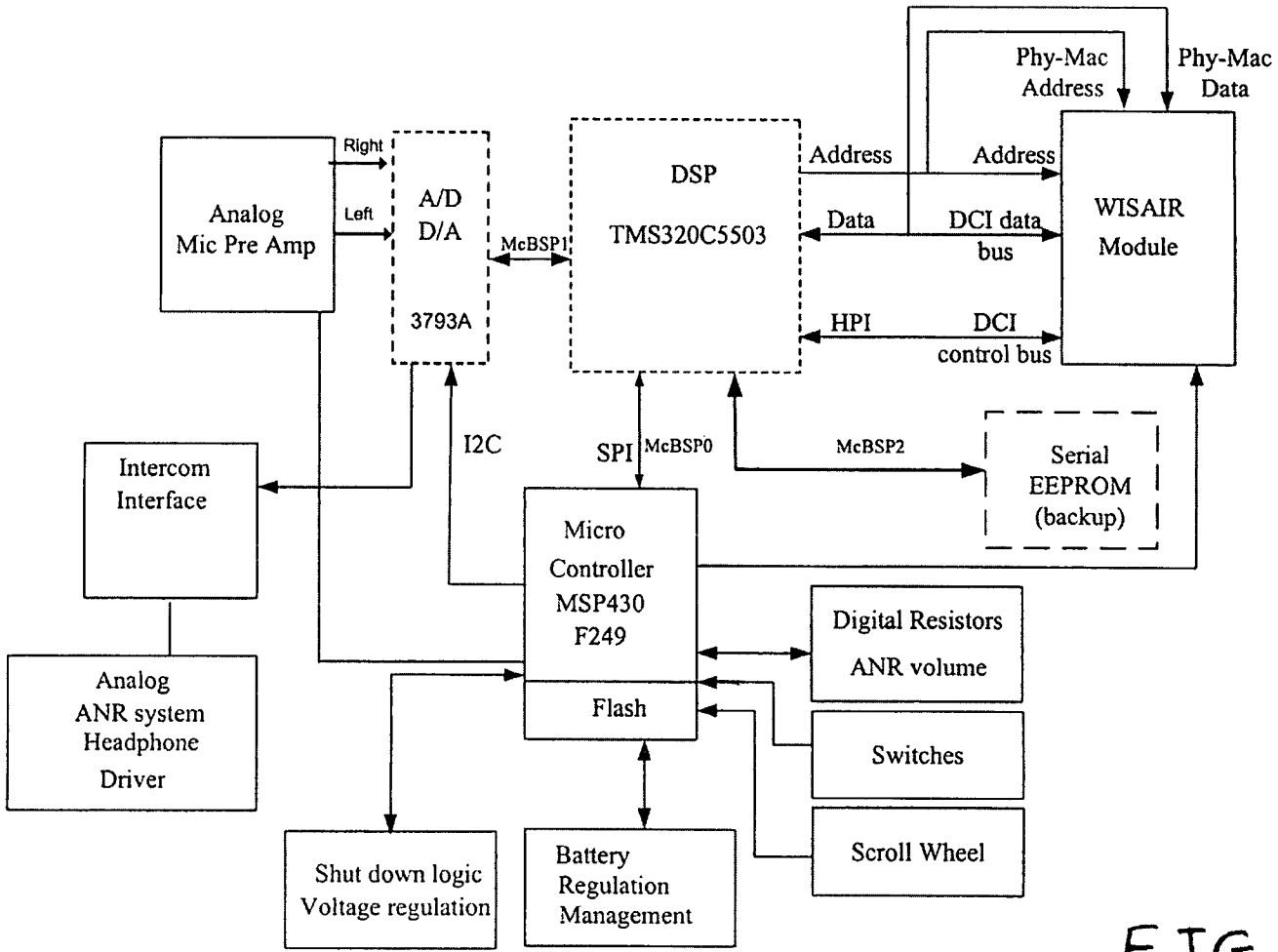
FIG. 6 is a block diagram of one specific embodiment of a UWB circuit suitable for use in the base station and/or headset of the wireless communication system of FIG. 3.

The block diagram of FIG. 6 illustrates one specific embodiment of a UWB circuit suitable for use in base station 28 and/or headset 32.

Implemented in various embodiments of methods of the present invention for operating a wireless communication system may be a sliding window packet transmission algorithm and/or an error correction and concealment algorithm. These algorithms may be implemented to either recover or reconstruct packetized audio information that has been lost or corrupted in transit. Other embodiments of methods of the present invention may implement an adaptive latency scheme in which transmission latency may be adaptively minimized. Other embodiments of the present invention may utilize a side tone cancellation and regeneration scheme that maybe used to filter side tones. It is to be understood that any combination of the above-identified four algorithms/schemes may be implemented in various embodiments of the invention.

The sliding window packet transmission algorithm may be implemented to best utilize the large communication bandwidth of the UWB channel while keeping the latency at a low level. In UWB, due to the large frequency bandwidth, there is a larger channel capacity according to the Shannon-Hartley theorem. The communication channel capacity needed for audio data is small (e.g., 0.25 mbps) compared to the UWB channel capacity (e.g., 53-400 mbps). The sliding packet scheme transmits each audio packet multiple times (e.g., four to eight times) in consecutive frames embedded along with previous and subsequent packets. At the receiving end, the packets are recovered from one or more of the frames that do not contain errors, and redundant copies of the packets are discarded. Packet numbers and frame numbers may be assigned in order to implement this sliding window packet transmission algorithm.

The level of latency may be reduced or increased, such as by playing the audio data faster or slower, in response to measured packet error rates. This adjustment of the latency level may be performed periodically in real time, i.e., automatically in the field. However, it is also possible for the latency level adjustment to be performed upon installation or at the factory.

In the scheme for correction and concealment of errors, if errorless packets are not received, a corrupted packet may be reconstructed from the redundant error packets. The erroneous copies of the packet may be combined by use of a voting algorithm to create a pseudo packet that represents the most probable packet. When corrections are not possible, the pseudo packet of data may be created with the error concealment algorithm to fill the gap in audio communication. The error concealment algorithm may use linear predictive coding (LPC), pitch detector, smoothing based on the previous information, and interpolation techniques. This algorithm may reduce audio artifacts due to lost packets, and may improve the intelligibility of the audio communications.

Figure 7:
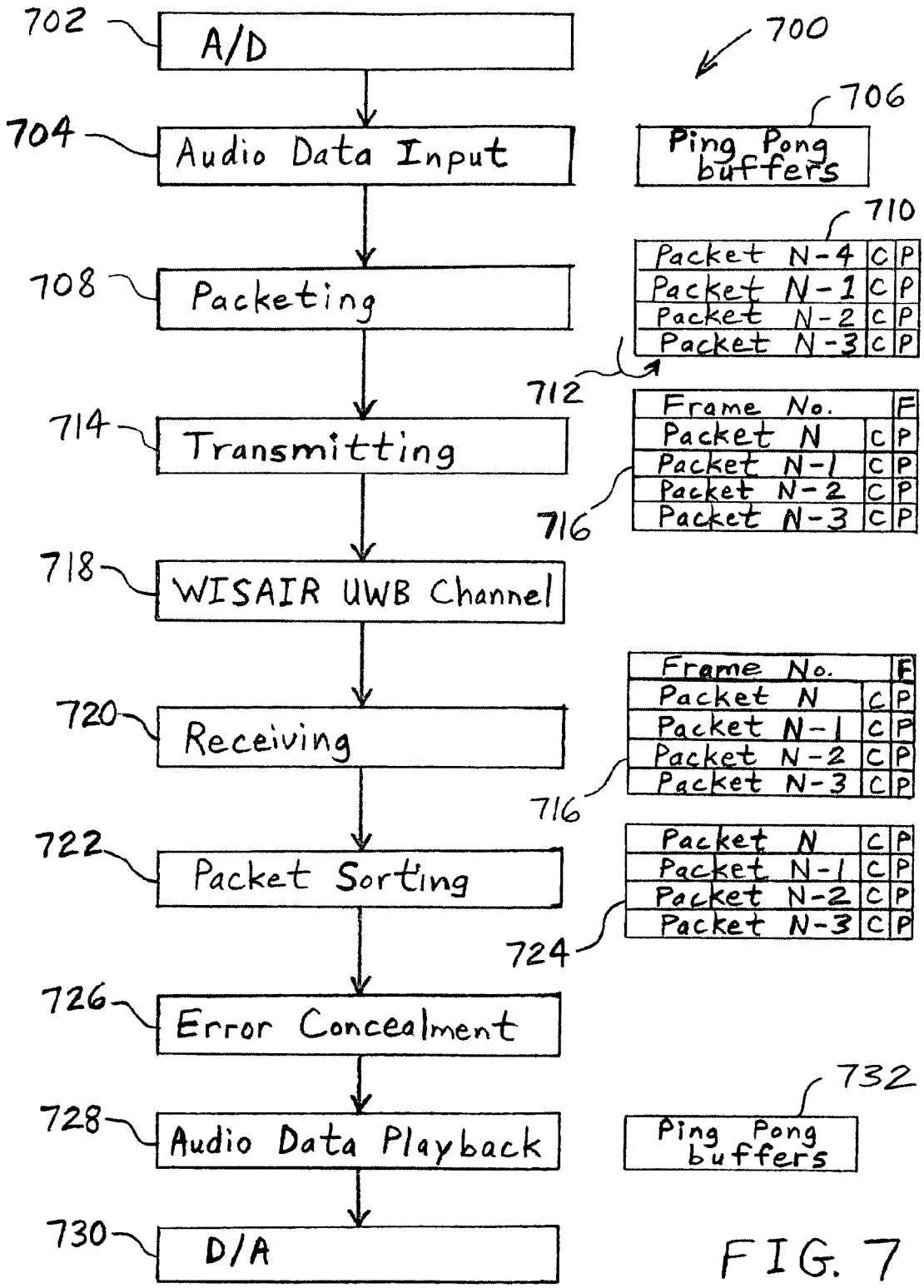
FIG. 7 is a flow chart illustrating one embodiment of a UWB data transmission procedure of the present invention suitable for use with the wireless communication system of FIG. 3.

One embodiment of a UWB data transmission procedure 700 according to the present invention is illustrated in FIG. 7. About two milliseconds of audio may be fed from analog-to-digital converter 702 to audio data input 704. At a sampling rate of 16 KHz, thirty-two samples are stored in ping pong buffers 706. Ping pong buffers 706 are utilized in double buffering in which input/output is performed simultaneously with processing. That is, data in one buffer may be processed while the next set of data is read into the other buffer.

As indicated at 708, the received audio data is organized into packets in packet buffer 710. As indicated by arrow 712, packet buffer 710 may be a circular buffer in which each packet shifts by one position with each newly received packet After appearing in each of the four positions, a packet is deleted to make room for the next packet to be received. Thus, each packet is transmitted four times, each time in a different frame. In order to successfully receive a packet, the packet need only be transmitted and received without an error in one or more of the four frames. At thirty-two samples per packet, the four packets in packet buffer 710 may represent one hundred twenty-eight samples, plus additional overhead for cyclic redundancy checks (indicated by "C" next to each packet) and packet identification numbers (indicated by "P" next to each packet).

In transmitting step 714, a transmitting frame 716 includes the frame identification number (indicated by "F") added to the above-described overhead and one hundred twenty-eight samples. The data, including eight milliseconds of audio data (two milliseconds of current data and six milliseconds of previous data from the three old packets) is transmitted on Wisair UWB Channel 718.

In receiving step 720, the same frame 716 that was transmitted in step 714 is received. In packet sorting step 722, the received frame 716 is sorted into packets 724. In step 726, the above-described error concealment algorithm may be performed. For example, if a packet is missing, then the data may be recreated. In the audio data playback step 728, about two milliseconds of audio may be fed to digital-to-analog converter 730. At the sampling rate of 16 KHz, thirty-two samples are stored in ping pong buffers 732, which are again utilized in double buffering.

In the adaptive latency reduction scheme mentioned above, audio latency may be adaptively reduced based on the channel error rates. This scheme may be performed by use of two packet numbers embedded in the packet inside the transmitted frame and the received frame. At the transmitting end and the receiving end, respectively, the packet number on the transmit buffer and the receive buffer are compared in order to determine the round trip delay in the link. If the delay is greater than a threshold length of time, then the audio data may be played faster by using a sample warping algorithm. In some instances, packets may be discarded and audio artifacts associated with the dropped packets may be concealed using the above-described error concealment algorithm. This scheme may be performed at both the transmitting and receiving sides of the link in order to inhibit increases in the audio latency between the base station and the headset. In addition to reducing the latency of the channel, this method may also avoid buildup of latency due to clock jitter and clock differences. Due to inevitable clock differences, without this latency adjustment in the system, data would be accumulated on the receiving end or would be stored in buffers on the transmitting end. This situation would cause the latency to increase with time during use of the headset The adaptive latency reduction scheme may prevent problems due to these issues.

As mentioned above, the present invention may make use of an adaptive filter-based side tone cancellation and regeneration scheme. As shown in the FIG. 8*a* depiction of the prior art, the side tones may be provided from an aviation intercom 826 to a wired headset 832 to inform the pilot that his voice is being transmitted to the tower. In a wireless communication system 920 (FIG. 8*b*) of the present invention, the wireless communication channel may introduce an additional delay to the communication. This delay may cause the side tone to arrive slightly later, such as by 20 to 50 milliseconds. This delay in the side tone can cause annoyance and does adversely affect the audio intelligibility. UWB communication system 920 includes an aviation intercom 926 connected by electrical conductors 930, 931 to a UWB base station 928. UWB base station 928 includes a side tone canceller 978 which employs a normalized least mean square (NLMS) based adaptive filter. Adaptive side tone canceller 978 may cancel the nonlinear side tone provided by intercom 926. Canceller 978 may also adaptively identify the bulk delay of intercom system 926. The same adaptive filter may be transmitted via the wireless link to the remote headset 932, where the filter is used by side tone generator 980 to create a side tone for the pilot. Side tone generator 980 receives input from microphone 982 and provides output to speaker 984. Thus, the delay in the side tone caused by the wireless link may be eliminated. The filter used in side tone canceller 978 may be the same as the filter used in side tone generator 980.

Figure 9:
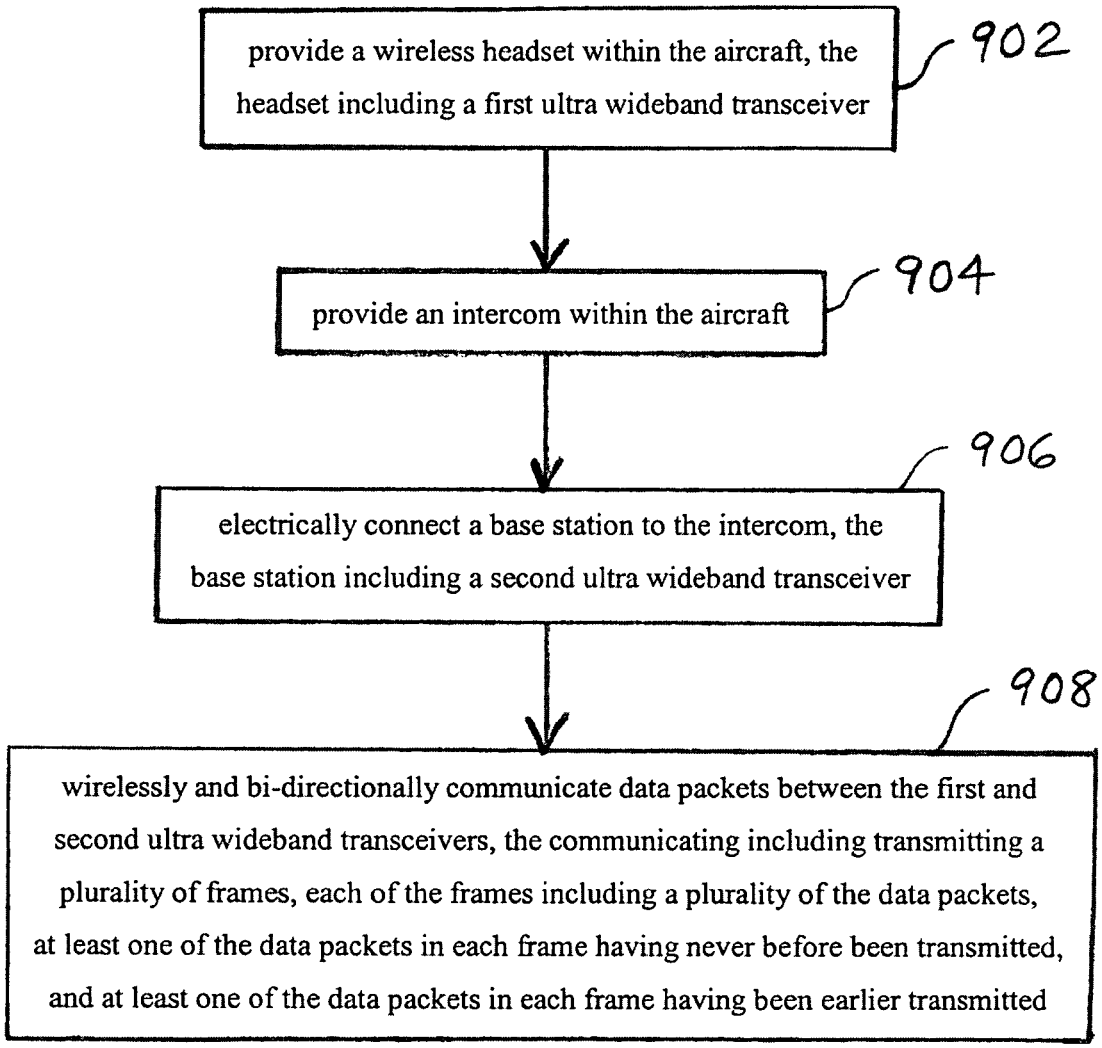
FIG. 9 is a flow chart of one embodiment of a method of the present invention for operating a wireless communication system for use in aircraft.

Illustrated in FIG. 9 is one embodiment of a method 900 of the present invention for operating a wireless communication system for use in aircraft. In a first step 902, a wireless headset including a first ultra wideband transceiver is provided within the aircraft. For example, as shown in FIG. 3, a headset 32 including a UWB transceiver 40 (FIG. 4) is provided within an aircraft 24.

In a next step 904, an intercom is provided within the aircraft In FIG. 3, intercom 26 is provided within aircraft 24.

Next, in step 906, a base station including a second ultra wideband transceiver is electrically connected to the intercom. That is, a base station 28 including UWB transceiver 38 (FIG. 4) is electrically connected to intercom 26 (FIG. 3).

Lastly, in step 908, data packets are wirelessly and bi-directionally communicated between the first and second ultra wideband transceivers, the communicating including transmitting a plurality of frames, each of the frames including a plurality of data packets, at least one of the data packets in each frame having never before been transmitted, and at least one of the data packets in each frame having been earlier transmitted. As shown in FIG. 4, wireless, bi-directional communication occurs between UWB transceivers 38, 40. As described above with reference to FIG. 7, the communication is in the form of digital data packets. The data packets maybe transmitted within frames such as transmitted frame 716, which includes four data packets. One of the data packets, i.e., data packet N, within frame 716 has not been transmitted before, and the other three data packets, i.e., data packets N-1, N-2 and N-3, within frame 716 have been transmitted in earlier frames.

Figure 10:
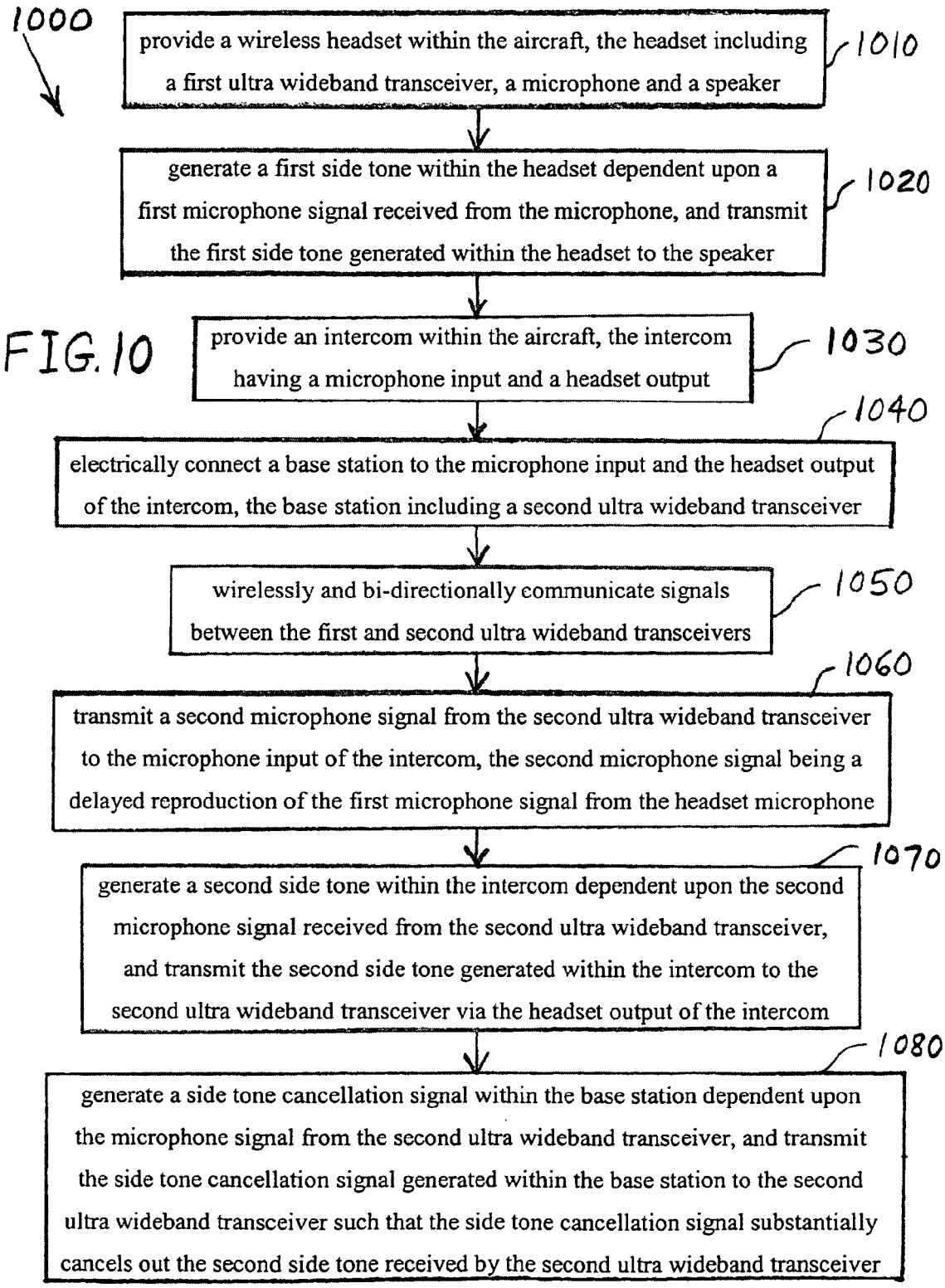
FIG. 10 is a flow chart of another embodiment of a method of the present invention for operating a wireless communication system for use in aircraft.

Illustrated in FIG. 10 is another embodiment of a method 1000 of the present invention for operating a wireless communication system for use in aircraft. In a first step 1010, a wireless headset including a first ultra wideband transceiver, a microphone and a speaker is provided within the aircraft. For example, as shown in FIG. 3, a headset 32 including a UWB transceiver 40 (FIG. 4), a microphone 53 and a speaker 55 is provided within an aircraft 24.

In a next step 1020, a first side tone is generated within the headset dependent upon a first microphone signal received from the microphone, and the first side tone generated within the headset is transmitted to the speaker. For example, as shown in FIG. 8*b*, a side tone is generated by side tone generator 980 within headset 932 based upon a signal received from microphone 982. Side tone generator 980 transmits the side tone to speaker 984.

Next, in step 1030, an intercom is provided within the aircraft, the intercom having a microphone input and a headset output. As illustrated in FIG. 3, an intercom 26 is provided within aircraft 24. As illustrated in FIG. 8*b*, intercom 926 has a microphone input labeled "Mic In" and a headset output labeled "Head phone Out."

In step 1040, a base station is electrically connected to the microphone input and the headset output of the intercom, the base station including a second ultra wideband transceiver. As shown in FIG. 8*b*, base station 928 is electrically connected to the microphone input and the headset output of intercom 926 via electrical conductors 930, 931, respectively. Base station 928 includes a UWB transceiver labeled "UWB System" in FIG. 8*b*.

Next, in step 1050, signals are wirelessly and bi-directionally communicated between the first and second ultra wideband transceivers. As shown in FIG. 4, wireless, bi-directional communication occurs between UWB transceivers 38, 40.

In a next step 1060, a second microphone signal is transmitted from the second ultra wideband transceiver to the microphone input of the intercom, the second microphone signal being a delayed reproduction of the first microphone signal from the headset microphone. In the embodiment of FIG. 8*b*, the UWB transmitter/"system" of base station 928 transmits a microphone signal to the "Mic In" input of intercom 926 via conductor 930. This microphone signal is a reproduction of the microphone signal produced by microphone 982, but is delayed, such as by 20 to 50 milliseconds, due to the time required for wireless communication between the two UWB transceivers.

Next, in step 1070, a second side tone is generated within the intercom dependent upon the second microphone signal received from the second ultra wideband transceiver, and the second side tone generated within the intercom is transmitted to the second ultra wideband transceiver via the headset output of the intercom. In FIG. 8*b*, a side tone is generated within intercom 926 by the side tone generator. This side tone is generated based upon the microphone signal received on the Mic In input from the UWB transceiver of base station 928. This side tone generated within intercom 926 is transmitted to the UWB transceiver of base station 928 via the Head phone Out output of intercom 926 and conductor 931.

In a final step 1080, a side tone cancellation signal is generated within the base station dependent upon the microphone signal from the second ultra wideband transceiver, and the side tone cancellation signal generated within the base station is transmitted to the second ultra wideband transceiver such that the side tone cancellation signal substantially cancels out the second side tone received by the second ultra wideband transceiver. That is, a side tone cancellation signal is generated within base station 928 by side tone canceller 978. This side tone cancellation signal is based upon the microphone signal carried on conductor 930 from the base station's UWB transceiver. The side tone cancellation signal is transmitted to the base station's UWB transceiver on the same conductor 931 that carries the side tone from intercom 926. The side tone cancellation signal may be equal in magnitude and opposite in sign to the side tone from intercom 926, thereby effectively cancelling out the side tone on conductor 931.

While this invention has been described as having an exemplary design, the present invention maybe further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of operating a wireless communication system for use in aircraft, comprising the steps of:

providing a wireless headset within the aircraft, the headset including a first ultra wideband transceiver;

providing an intercom within the aircraft;

electrically connecting a base station to the intercom, the base station including a second ultra wideband transceiver; and wirelessly and bi-directionally communicating data packets between the first and second ultra wideband transceivers, the communicating including transmitting a plurality of frames, each of the frames including a plurality of said data packets, at least one of the data packets in each frame having never before been transmitted, and at least one of the data packets in each frame having been earlier transmitted.

2. The method of claim 1 wherein each of the data packets is transmitted approximately between four and eight times.

3. The method of claim 2 comprising the further step of creating a most probable version of each said data packet based on the four to eight transmissions of each said data packet.

4. The method of claim 1 wherein each of the transceivers converts analog signals to digital data, each of the transceivers inputting a first portion of the digital data while simultaneously processing a second portion of the digital data.

5. The method of claim 1 wherein each of the transceivers converts digital data to analog signals, each of the transceivers outputting a first portion of the digital data while simultaneously processing a second portion of the digital data.

6. The method of claim 1 wherein a single said data packet that has never before been transmitted is included in each said frame.

7. The method of claim 1 comprising the further step of adjusting a speed with which the data packets are played on the headset, the adjusting being dependent upon a measured level of latency.

8. The method of claim 1 wherein each frame includes at least one of a frame number, packet number, and cyclic redundancy check.

9. The method of claim 1 wherein each said data packet occupies a different position within each said frame in which said data packet is transmitted.

10. A method of performing an ultra wide band data transmission procedure, comprising the steps of:

providing a wireless headset within the aircraft, the headset including a first ultra wideband transceiver;

providing an intercom within the aircraft;

electrically connecting a base station to the intercom, the base station including a second ultra wideband transceiver; and wirelessly and bi-directionally communicating data packets between the first and second ultra wideband transceivers, the communicating including transmitting a plurality of frames, each of the frames including a plurality of said data packets, wherein, after an initial frame has been transmitted in the communicating step, at least one of the data packets in each frame having never before been transmitted during the communicating step, and at least one of the data packets in each frame having been earlier transmitted during the communicating step.

11. The method of claim 10 wherein, after an initial frame has been transmitted in the communicating step, at least one of the data packets in each frame having been transmitted in an immediately preceding said frame.

12. The method of claim 10 wherein, after an initial frame has been transmitted in the communicating step, one of the data packets in each frame having never before been transmitted during the communicating step, and all other ones of the data packets in each frame having been transmitted in an immediately preceding said frame.

13. The method of claim 10 wherein each of the communicated data packets is received in a circular packet buffer having a plurality of positions, each previously-received said data packet shifting by one said position in the circular packet buffer with each newly received data packet.

14. A method of operating a wireless communication system for use in aircraft, comprising the steps of:

providing a wireless headset within the aircraft, the headset including a first ultra wideband transceiver;

providing an intercom within the aircraft;

connecting a base station to the intercom, the base station including a second ultra wideband transceiver; and wirelessly and bi-directionally communicating data packets between the first and second ultra wideband transceivers, the communicating including transmitting a plurality of frames, each of the frames including a plurality of said data packets, at least one of the data packets in each frame having never before been transmitted, and at least one of the data packets in each frame having been earlier transmitted.

15. The method of claim 14 wherein each of the transceivers converts analog signals to digital data, each of the transceivers inputting a first portion of the digital data while simultaneously processing a second portion of the digital data.

16. The method of claim 14 wherein each of the transceivers converts digital data to analog signals, each of the transceivers outputting a first portion of the digital data while simultaneously processing a second portion of the digital data.

17. The method of claim 14 wherein a single said data packet that has never before been transmitted is included in each said frame.

18. The method of claim 14 comprising the further step of adjusting a speed with which the data packets are played on the headset, the adjusting being dependent upon a measured level of latency.

19. The method of claim 14 wherein each frame includes at least one of a frame number, packet number, and cyclic redundancy check.

20. The method of claim 14 wherein each said data packet occupies a different position within each said frame in which said data packet is transmitted.

* * * * *